US006807694B1

(12) United States Patent
Miller

(10) Patent No.: US 6,807,694 B1
(45) Date of Patent: Oct. 26, 2004

(54) BEDDING ARRANGEMENT AND METHOD OF MAKING A PILLOW AND MATTRESS

(75) Inventor: Norma Miller, Fuquay-Varina, NC (US)

(73) Assignee: Bob Barker Co., Inc., Fuquay-Varina, NC (US)

( * ) Notice: Subject to any disclaimer, the term of this patent is extended or adjusted under 35 U.S.C. 154(b) by 0 days.

(21) Appl. No.: 10/426,259

(22) Filed: Apr. 30, 2003

(51) Int. Cl.[7] ..... A47G 9/08
(52) U.S. Cl. ..... 5/482; 5/490
(58) Field of Search ..... 5/482, 480, 419, 5/740, 413 AM, 413 R, 490

(56) References Cited

U.S. PATENT DOCUMENTS

| | | | |
|---|---|---|---|
| 3,372,407 | A | 3/1968 | Weber, III |
| 4,006,503 | A | 2/1977 | Wood |
| 5,117,517 | A | 6/1992 | Su |
| 6,351,864 | B1 | 3/2002 | Karafa et al. |
| 6,516,482 | B2 | 2/2003 | Karafa et al. |

OTHER PUBLICATIONS

Medline; Skin Care/Pressure Relief Products 2 pgs.

Flop–a–Cot from Versatile Products, Inc.; Mattress With Built–In Pillow, Attached Blanket And Detachable Water–Proof Mat All In One; http://www.littleangels.net/; Mar. 14, 2003; 2 pgs.

Mattress; Fisher–Price Doll House (1978–1985 Series); 1 pg.

*Primary Examiner*—Teri Pham Luu
*Assistant Examiner*—Fredrick Conley
(74) *Attorney, Agent, or Firm*—Coats & Benneth, P.L.L.C.

(57) ABSTRACT

A bedding arrangement having a first pillow section and a second mattress section. The first pillow section has an interior core section contained within a first cover. The second mattress section includes an interior core section contained within a second cover. A connection extends between and attaches the first pillow section and second mattress section. A method of making the bedding arrangement comprises attaching together the first cover and the second cover along a common edge. The pillow core and the mattress core are then placed within the interior and the covers are closed to contain the cores.

20 Claims, 6 Drawing Sheets

BEDDING ARRANGEMENT AND METHOD OF MAKING A PILLOW AND MATTRESS

BACKGROUND

Institutional facilities including correctional institutions, hospitals, schools, and the like accommodate persons during sleeping hours. Often times it is not feasible for these facilities to provide regular beds that include a frame, box springs, and mattress. Regular beds may be too expensive, require too much storage space, or not be practical. Therefore, alternative means of providing a bed must be provided. Various types of beds have been used in the past each with varying inadequacies.

Because of the use in institutional facilities, the beds are used by many different people and often need cleaning. One drawback of previous designs is the difficulty in cleaning the beds. Several previous designs require the bed to be disassembled with each of the component parts being cleaned and then reassembled prior to the next use. Previous bed designs that cannot be disassembled may not be able to be cleaned adequately prior to the next use. Additionally, some previous bed designs were constructed of materials that contributed to uncleanly conditions. Materials that are absorbent or do not resist fluid result in the inner sections of the bed becoming soiled. This often required the bed to be destroyed.

Many prior bed designs were unacceptable for use in correctional institutions that house violent persons. The beds could be disassembled with the component parts used by persons to injure themselves or others. The persons could further rip into the interior of the beds to hide contraband that is forbidden within the correctional institution. The beds were not constructed adequately resulting in the beds being destroyed and requiring replacement. Once the beds were disassembled, they were no longer usable and had to be destroyed.

The prior art bed designs further were not economical for their intended purpose. A bed that met the requirements of the facility was too expensive. Beds that were within a budget were inferior in comfort, cleaning ability, durability, or other necessary aspect.

SUMMARY

The present invention is directed to a bedding arrangement having a mattress section and an attached pillow. The mattress includes a mattress core contained within a first cover. The pillow includes a pillow core contained within a second cover. The first and second covers are attached together forming a connection positioned between the mattress section and pillow section with the pillow section being positioned away from the mattress section (i.e., in a non-overlapping orientation). The connection provides for the pillow section to be movable relative to the mattress section. This construction provides an economical bedding arrangement which is durable, straight-forward to clean, and prevents persons from damaging or otherwise disassembling the mattress and/or pillow.

The present invention also provides a method of constructing the bedding arrangement. One or more sheets are obtained for forming the pillow cover, and one or more sheets are obtained for forming the mattress cover. In the embodiment having one sheet, the sheet is folded forming an edge with the opposite side being attached together. In the embodiment using two sheets, the sheets are overlapped and at least two sides are attached together. Attachment of the sheets is accomplished using stitching or other attachment means. The pillow cover and mattress cover are than attached together along one of the edges. In this state, the covers are connected with at least one edge of each of the pillow and mattress being open. A pillow core is placed within the interior of the pillow cover and then sealed within the interior. Likewise, a mattress core is placed within the interior of the mattress cover and sealed within the interior.

DETAILED DESCRIPTION

Figure 1:
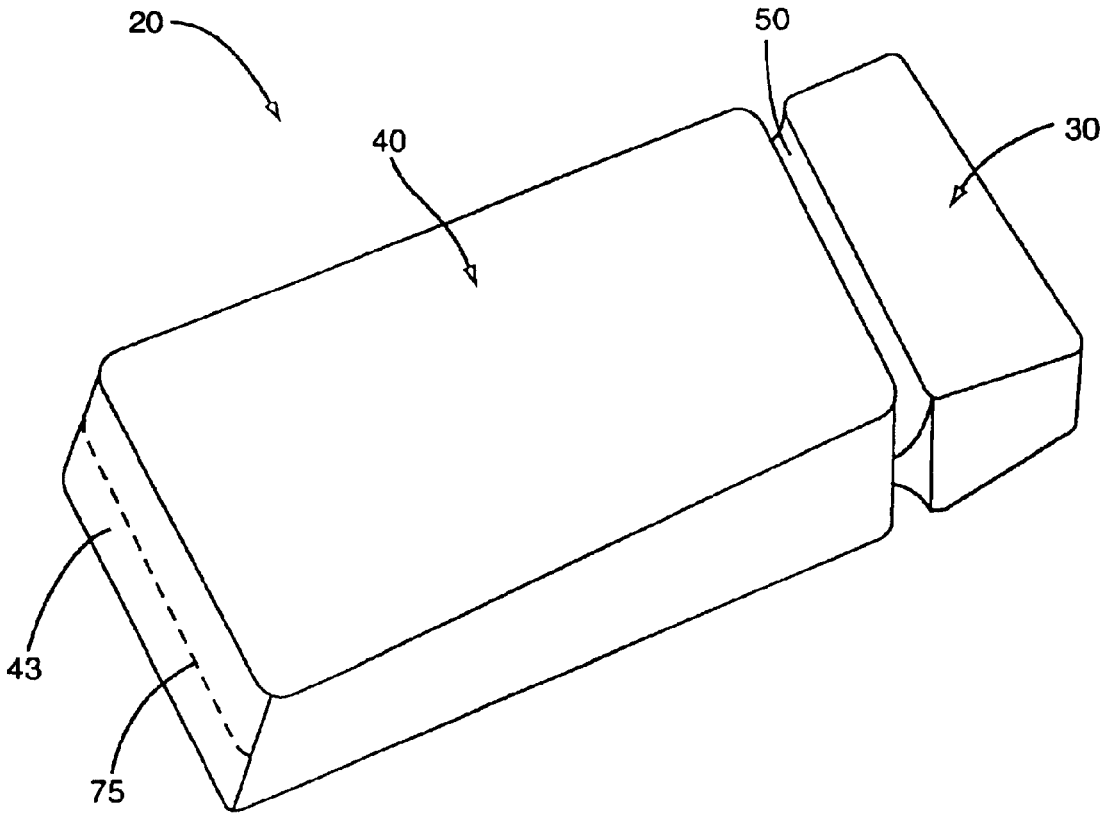
FIG. 1 is a perspective view one embodiment of the bedding arrangement of the present invention.

The present invention is directed to a bedding arrangement, generally illustrated as 20 in FIG. 1, having a pillow section 30 and a mattress section 40. A connection 50 extends between and connects the pillow section 30 and mattress section 40. The connection 50 is movable such that the pillow section 30 is adjustable relative to the mattress section 40.

Figure 2:
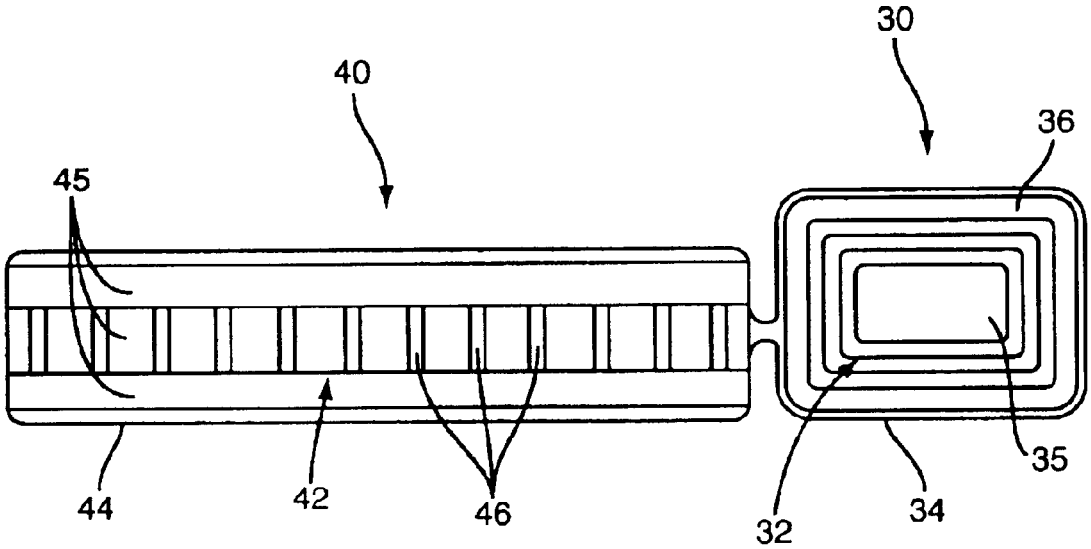
FIG. 2 is a cross-sectional view of one embodiment of the bedding arrangement of the present invention.

The pillow section 30 is positioned at an end of the mattress section 40 to support the head of a user. As illustrated in FIG. 2, the pillow section 30 has a pillow core 32 contained within a first cover 34. The pillow core 32 may be constructed of a variety of materials. In one embodiment, pillow core 32 is constructed of one or more members 35. In another embodiment, batting 36 is wrapped around the pillow core 32. In this embodiment, the batting 36 provides a softer feel to the user with the one or more members 35 providing support. In another embodiment, the pillow core 32 is entirely constructed of batting 36. Pillow section 30 may have a variety of widths relative to the mattress section 40. In one embodiment illustrated in FIG. 2, the width of the pillow section 30 is greater than the width of the mattress section 40. In another embodiment illustrated in FIG. 1, the width of the pillow section 30 is substantially equal to the width of the mattress section 40.

The mattress section 40 is sized to support the body of the user. The mattress section 40 has a mattress core 42 contained within a second cover 44. The mattress core 42 may be constructed of a variety of materials. In one embodiment, mattress core 42 is constructed of one or more members 45. Mattress section 40 may have a variety of thicknesses and widths relative to the pillow section 30.

The members 35, 45 within the pillow core 32 and mattress core 42 may be constructed of various materials. Embodiments include foam pads, cotton pads, and polyester pads. The term "pad" is used herein to define an object having a defined height, length, and width. In one embodiment, foam pads are constructed of highly flame resistant polymerized synthetic open celled cushioning foam. One embodiment of the foam pad is FIRE SEAL available from Foamex of Compton, Calif. In one embodiment, the polyester pad is constructed of thermally bonded polyester fiber. One embodiment of the polyester pad is a thermally-bonded polyester pad available from Cumulus Fibre of Statesville, N.C. In one embodiment, the cotton pad comprises recycled post industrial denim and cotton fibers bonded together by poly fibers (maximum 10%). One embodiment of the cotton pad is available from Bonded Logic of Chandler, Ariz. Batting 36 may also be included within the pillow core 32 and mattress core 42. In one embodiment, batting is a sheet-like member that is wound around the pads. One embodiment of batting materials is boric acid treated 100% virgin cotton batting manufactured by Trace Industries.

In one embodiment, the mattress core 42 includes a perforated pad having a series of apertures 46. In one embodiment, apertures 46 have a diameter of about ¾ inch and are spaced on a 5-inch square pattern. The apertures 46 provide for a more comfortable feel for the use, and also allows for bending the cotton pad such that the bedding arrangement 20 can be stored in a folded orientation. In one embodiment, the pad is constructed of cotton and has a thickness of about five inches.

In one embodiment, the polyester pad is made of thermally bonded polyester fiber. The polyester fibers are processed through either a garneting operation of air-layering. In one embodiment, the foam pad is a highly flame resistant polymerized synthetic open celled cushioning foam. In one embodiment, the cotton pad is composed of re-cycled post industrial denim and cotton fibers with a ply fiber (maximum of 10%) that binds and solidifies the cotton matrix. In one embodiment, cotton pad is 25"×75"×4" and weighs about 18 lbs.

First cover 34 surrounds pillow core 32, and second cover 44 surrounds mattress core 42. First and second covers 34, 44 may be constructed from the same material, or may be constructed from different materials. First and second covers 34, 44 may be constructed of materials that are antibacterial, antimicrobial, antifungal, fluid resistant, and fire resistant. Fire resistance is determined using NFPA-701 Large Scale Test, and a cigarette ignition test of laying a burning, unfiltered cigarette on the material to determine ignition. Materials used for constructing the first and second covers include HERCULITE XL manufactured by Herculite Products, Inc. of Emigsville, Pa., SOFTTICK manufactured by Vintex of Mt. Forest, Ontario, Canada. The thickness of the materials may vary, and embodiments include material thickness within the range of about 15 mil–26 mil, and may have a weight in ounces per yard ranging from about 7.0 to about 13.0.

In one embodiment, multiple members 35, 45 each have about the same length and width when forming a multiple pad design for the pillow core 32 or the mattress core 42, respectively.

Figure 3:
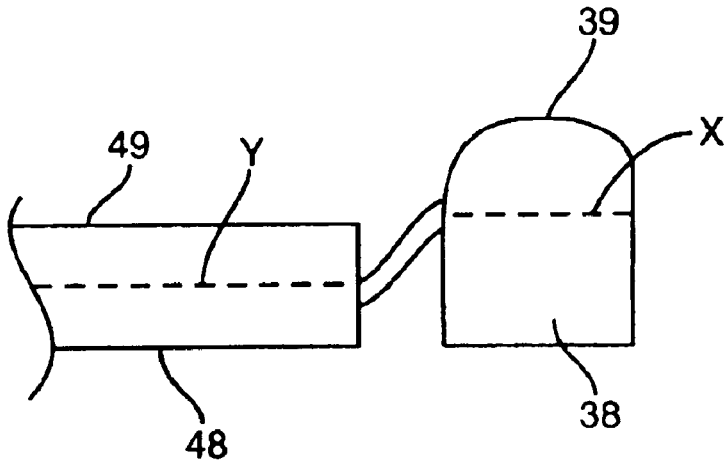
FIG. 3 is a side view of one embodiment of the bedding arrangement of the present invention.

Connection 50 is positioned between and connects the pillow section 30 to the mattress section 40. The connection 50 is positioned to prevent the pillow core 32 from overlapping with the mattress core 42. In one embodiment as illustrated in FIG. 3, connection 50 is positioned at a vertical center line X of the pillow section 30 and a vertical center line Y of the mattress section 40. In another embodiment, the connection 50 is positioned at bottom edge of the pillow section 30 and a bottom edge of the mattress section 40. In one embodiment, connection 50 is flexible such that the pillow section 30 can be adjusted relative to the mattress section 40.

Figure 4:
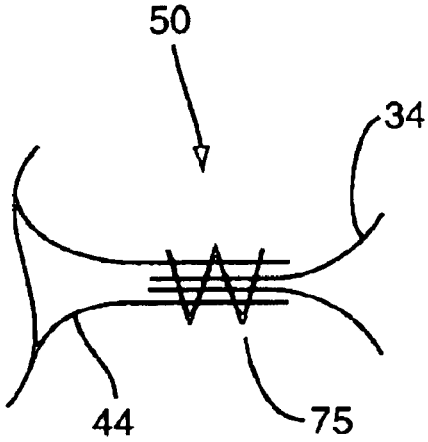
FIG. 4 is partial cross-sectional view of a connection according to one embodiment of the present invention.

FIG. 4 illustrates one embodiment of the connection 50. First cover 34 which surrounds the pillow core 32 is positioned within the second cover 44 which surrounds the mattress core 42. Attachment means 75 extends through the first cover 34 and second cover 44 to connect the two components. The connection 50 is constructed from the overlap between the covers 34, 44 and is flexible providing for the pillow section 30 to be movable relative to the mattress section 40. In one embodiment, the connection 50 is positioned adjacent to the pillow section 30 and mattress section 40.

Figure 5:
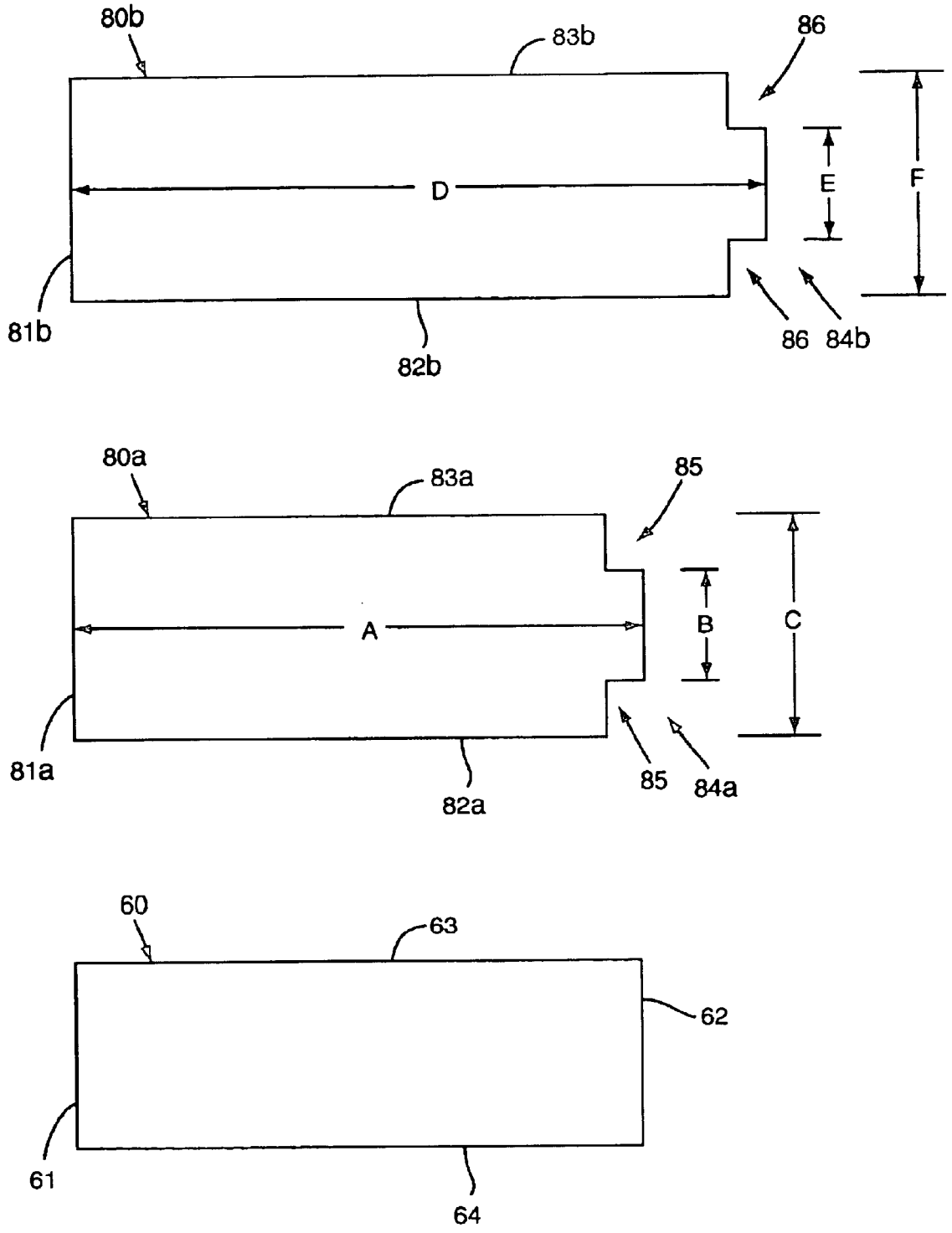
FIG. 5 is a top view of a single sheet that forms a first cover and two sheets that form a second cover according to one embodiment of the present invention.
Figure 6:
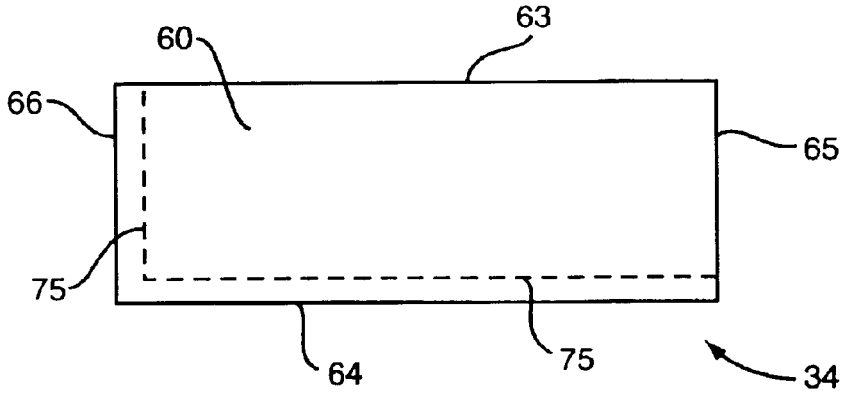
FIG. 6 is top view of the sheets in FIG. 5 in which the single sheet of the first cover is folded and attached along two edges forming a first section, and the two sheets of the second cover in an overlapping arrangement and attached along two edges forming a second section according to one embodiment of the present invention.
Figure 6:
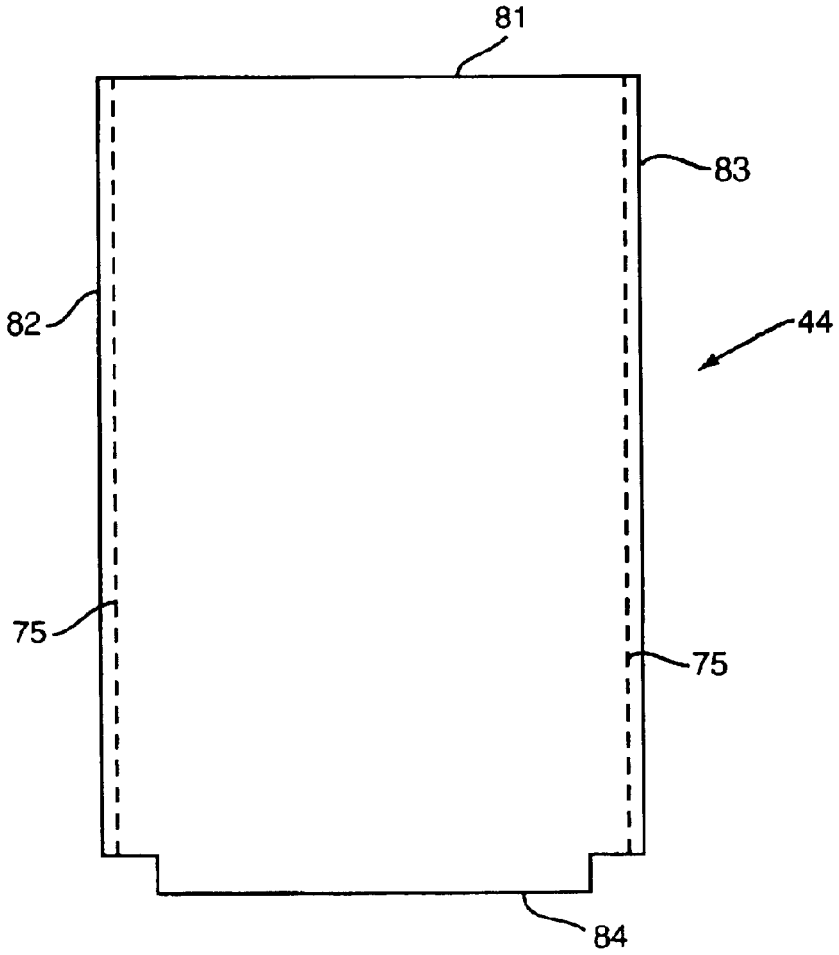
Figure 7:
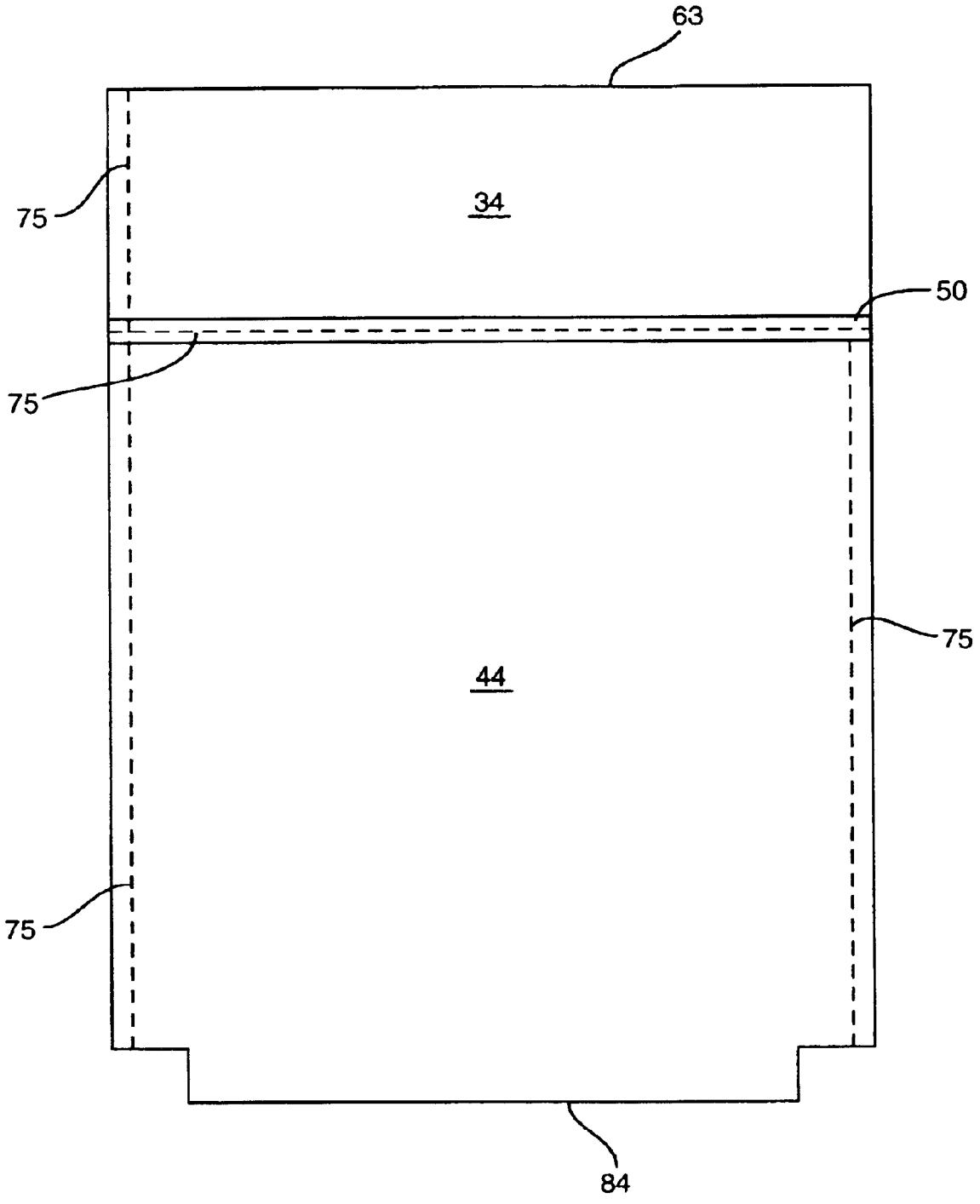
FIG. 7 is a top view of the first and second sections of FIG. 6 attached together.

FIGS. 5 through 7 illustrate one method of making the bedding arrangement 20. The initial step is obtaining three pieces of material for making the first and second covers 34, 44. The first cover 34 is constructed of a single sheet 60 having an elongated shape with a length greater than the width. Edges 63 and 64 extend along the length, with edges 61 and 62 extending along the width. In one embodiment, the length is about 59 inches and the width is about 21 inches.

The second cover 44 for containing the mattress core 42 is constructed of a first sheet 80*a* and a second sheet 80*b*. In one embodiment, first sheet 80*a* has an overall length A of about 61 inches and an overall width C of about 29 inches. Edges 82*a* and 83*a* extend along the length, and edges 81*a* and 84*a* extend along the width. Indents 85 are cut from edge 84*a*. In one embodiment, indents are about 3 inches wide and 0.5 inches deep. Therefore, the width B measured between the indents 85 is about 23 inches. In one embodiment, second sheet 80*b* has an overall length D of about 66 inches and an overall width F of about 30 inches. Edges 82*b* and 83*b* extend along the length, and edges 81*b* and 84*b* extend along the width. Indents 86 are positioned on edge 84*b* and have dimensions of about 3 inches by about 5 inches. Therefore, width E is about 24 inches.

FIG. 6 illustrates sheet 60 in a folded orientation with edge 65 being the fold and edges 61, 62 aligning to form an opposite edge 66. In one embodiment, edges 61 and 62 are attached together forming edge 66 using attachment means 75, and edge 64 is attached together using attachment means 75 such that only edge 63 remains open to access the interior. In one embodiment, edge 64 is not attached and remains open.

Sheets 80*a* and 80*b* are aligned together with edges 81*a* and 81*b* forming edge 81, edges 82*a* and 82*b* forming edge 82, edges 83*a* and 83*b* forming edge 83, and edges 84*a* and 84*b* forming edge 84. Because sheet 81*b* has a longer overall length (D>A), edge 84*b* extends further than edge 84*a*. Edges 82*a* and 82*b* are attached together as are edges 83*a* and 83*b*. In one embodiment, edges are attached together using attachment means 75. Edge 81 and edge 84 remain open.

FIG. 7 illustrates the step of connecting the first cover 34 with the second cover 44. In one embodiment, edge 64 of the first cover 34 is placed within the edge 81 of the second cover 44. The two sections 34, 44 are then attached together using attachment means 75 forming connection 50. At this point, edge 63 is open for accessing the interior of the first cover 34, and edge 84 is open for accessing the interior of the second cover 44. Pillow core 32 is placed within the first cover 34 and edge 63 is closed. Mattress core 32 is placed within the second cover 44 and edge 84 is closed. Indents 85, 86 provide for making a uniform corner having a minimum of overlapping material when the edge 84 is closed.

In another embodiment, the first cover 34 is attached to the second cover 44 along connection 50. At this point, both the first cover 34 and second cover 44 are reversed (i.e., turned inside-out). Reversing the covers 34, 44 places the attachment means 75 on the interior of the first and second covers 34, 44 where they are not visible or exposed. This provides for a more pleasing aesthetic appearance and makes it more difficult for a person to damage the bedding arrangement 20 by tearing open either cover 34, 44 to possibly hide contraband, or separate the pillow section 30 from the mattress section 40.

In one embodiment, attachment means 75 include stitching. In one embodiment, attachment means is lock stitching. Other methods of attachment means 75 include staples, adhesives, heat sealing by means such as radio frequency, thermal or sonic welding, or chemical, adhesive, or cement bonding. Different types of attachment means 75 may be used on a single bedding arrangement 20.

In one embodiment, first cover 34 is constructed of two separate sheets. In this embodiment, first cover 34 is constructed in a similar fashion as that described for the second cover 44 in FIGS. 5 through 7. Likewise, second cover 44 may be constructed of a single sheet and constructed in a similar fashion as that described for the first cover 34 in FIGS. 5 through 7.

The present invention may be carried out in other specific ways than those herein set forth without departing from the scope and essential characteristics of the invention. The covers 34, 44 prevent layers of pillow core 32, 42 from slipping relative to each other. Therefore, the layers do not need to be connected together. In one embodiment, the first cover 34 is attached to the second cover 44 with edge 81 positioned within edge 64. The present embodiments are, therefore, to be considered in all respects as illustrative and not restrictive, and all changes coming within the meaning and equivalency range of the appended claims are intended to be embraced therein.

What is claimed is:

1. A bedding arrangement comprising:

a pillow section;

a mattress section;

a first cover sized to extend around the pillow section;

a second cover sized to extend around the mattress section; and a connection positioned between and connecting the mattress to the pillow with an edge of the first cover being within the second cover and the pillow section being positioned apart from the mattress section.

2. The bedding arrangement of claim 1, wherein the connection is constructed of an attachment means for connecting the first cover to the second cover and being flexible to adjust the angular position of the pillow section relative to the mattress section.

3. The bedding arrangement of claim 1, wherein the pillow section has a width greater than the mattress section.

4. The bedding arrangement of claim 1, wherein the connection is positioned at a vertical centerline of the pillow section and the mattress section.

5. The bedding arrangement of claim 1, wherein the mattress comprises a pad having apertures.

6. The bedding arrangement of claim 5, wherein the mattress further comprises a second pad aligned with the pad, the second pad being constructed of a material different than the pad.

7. The bedding arrangement of claim 1, wherein the mattress is constructed of cotton.

8. The bedding arrangement of claim 1, wherein the pillow cover is constructed of a single material sheet and the mattress cover is constructed of multiple material sheets.

9. A bedding arrangement comprising:

a first section having a pillow core and a first cover extending around the pillow core;

a second section having a mattress core and a second cover extending around the mattress core; and a third section positioned between the first section and the second section and having attachment means for connecting edges of the first cover and the second cover in an overlapping orientation with the first section positioned within the second section.

10. The bedding arrangement of claim 9, wherein a fold forms a first edge of the first cover and a lock stitch extends around a remainder.

11. The bedding arrangement of claim 9, wherein the pillow comprises a foam member positioned within a batting material.

12. The bedding arrangement of claim 9, wherein the mattress core comprises a plurality of members positioned in an overlapping arrangement.

13. The bedding arrangement of claim 12, wherein one of the plurality of members includes a plurality of spaced apart apertures.

14. A method of making a bedding arrangement comprising the steps of:

forming a pillow cover using a first sheet of material;

forming a mattress cover using a second sheet of material;

attaching together the pillow cover and the mattress cover along a common edge with the pillow cover positioned within the mattress cover;

inserting a pillow core within the pillow cover and closing the pillow cover; and inserting a mattress core within the mattress cover and closing the mattress cover.

15. The method of claim 14, further comprising forming apertures within the mattress core prior to insertion within the mattress cover.

16. A method of making a bedding arrangement comprising the steps of:

forming a pillow cover having a first open edge and a second edge;

forming a mattress cover having a third open edge and a fourth edge;

inserting the second edge of the pillow cover within the fourth edge of the mattress cover;

attaching together the second edge and the fourth edge;

inserting a pillow core within the pillow cover through the first open edge;

closing the first open edge to contain the pillow core within the pillow cover;

inserting a mattress core within the mattress cover through the third open edge; and closing the third open edge to contain the mattress core within the mattress cover.

17. The method of claim 16, wherein the step of forming the pillow cover comprises folding a single sheet in an overlapping orientation.

18. The method of claim 16, further comprising forming indents on the mattress cover at a position opposite the fourth edge.

19. The method of claim 16, further comprising reversing the orientation of the first cover and the second cover after the step of attaching together the second edge and the fourth edge.

20. The method of claim 16, further comprising forming apertures in the mattress core prior to placing the mattress core within the mattress cover.

* * * * *